US009857746B2

(12) United States Patent
Okamura et al.

(10) Patent No.: US 9,857,746 B2
(45) Date of Patent: Jan. 2, 2018

(54) IMAGE FORMING APPARATUS

(71) Applicant: Konica Minolta, Inc., Chiyoda-ku, Tokyo (JP)

(72) Inventors: Kei Okamura, Yokohama (JP); Hiroshi Morimoto, Akiruno (JP); Wataru Watanabe, Hachioji (JP); Shunichi Takaya, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/190,785

(22) Filed: Jun. 23, 2016

(65) Prior Publication Data

US 2016/0378035 A1 Dec. 29, 2016

(30) Foreign Application Priority Data

Jun. 25, 2015 (JP) ..... 2015-127484

(51) Int. Cl.
*G03G 15/00* (2006.01)

(52) U.S. Cl.
CPC . *G03G 15/5058* (2013.01); *G03G 2215/0135* (2013.01); *G03G 2215/0164* (2013.01)

(58) Field of Classification Search
CPC ..... G03G 15/5058; G03G 2215/0135; G03G 2215/0164
See application file for complete search history.

(56) References Cited

U.S. PATENT DOCUMENTS 6,535,706 B1 * 3/2003 Konno ..... H04N 1/626 358/452
8,849,134 B2 * 9/2014 Ogawa ..... G03G 15/5058 358/1.9
2009/0016758 A1 * 1/2009 Matsuzaki ..... G03G 15/065 399/60

FOREIGN PATENT DOCUMENTS

JP 2010102098 A 5/2010
JP 2013195586 A 9/2013
JP 2014219453 A 11/2014

OTHER PUBLICATIONS

Japanese Notice of Reasons for Rejection corresponding to Application No. 2015-127484; dated May 10, 2017.

* cited by examiner

*Primary Examiner* — David M Gray
*Assistant Examiner* — Michael Harrison
(74) *Attorney, Agent, or Firm* — Cantor Colburn LLP

(57) ABSTRACT

An image forming apparatus includes: an image forming unit including a rotating member and being configured to form an image on a paper sheet in accordance with print job data; a rotation position detecting unit configured to detect a rotation position of the rotating member; an image density detecting unit configured to detect a density in an image formed on an image carrier; an image information analyzing unit configured to analyze image information in the print job data; a density profile managing unit configured to form a correction patch image on the image carrier, and create and manage a density profile indicating periodical density unevenness; a correction data creating unit configured to create correction data; a density correcting unit configured to perform density correction; and a density correction control unit configured to predict an appearance of periodical den- (Continued)

sity unevenness, and set conditions for the density correction.

10 Claims, 8 Drawing Sheets

FIG. 8

| REFERENCE IMAGE DETERMINING TABLE | | DETERMINED DISTANCE L | | | | |
|---|---|---|---|---|---|---|
| | | $L \leq a/2$ | $a/2 < L \leq a$ | $a < L \leq 2a$ | $2a < L \leq b$ | $b < L$ |
| MEAN DENSITY D | $60 < D-C$ | 1 | 2 | 3 | 4 | 5 |
| | $40 < D-C \leq 60$ | 2 | 3 | 4 | 5 | 6 |
| | $20 < D-C \leq 40$ | 3 | 4 | 5 | 6 | 7 |
| | $10 < D-C \leq 20$ | 4 | 5 | 6 | 7 | 8 |
| | $-10 < D-C \leq 10$ | 5 | 6 | 7 | 8 | 9 |
| | $-20 < D-C \leq -10$ | 4 | 5 | 6 | 7 | 8 |
| | $-40 < D-C \leq -20$ | 3 | 4 | 5 | 6 | 7 |
| | $-60 < D-C \leq -20$ | 2 | 3 | 4 | 5 | 6 |
| | $D-C \leq -60$ | 1 | 2 | 3 | 4 | 5 |

a: CYCLE LENGTH OF DEVELOPER CARRIER
b: CYCLE LENGTH OF PHOTOSENSITIVE DRUM
C: REFERENCE DENSITY

IMAGE FORMING APPARATUS

CROSS REFERENCE TO RELATED APPLICATIONS

The entire disclosure of Japanese Patent Application No. 2015-127484 filed on Jun. 25, 2015 including description, claims, drawings, and abstract are incorporated herein by reference in its entirety.

BACKGROUND OF THE INVENTION

Field of the Invention

The present invention relates to an electrophotographic image forming apparatus, and more particularly, to a technology for correcting periodical density fluctuations that occur in the sub-scan direction.

Description of the Related Art

In an image forming apparatus (such as a printer, a copying machine, or a facsimile machine) using an electrophotographic process technology, an electrostatic latent image is normally formed on the surface of a photosensitive member (a photosensitive drum, for example) when the photosensitive member that is uniformly charged is illuminated with (exposed to) light based on input image data. Toner is then applied onto the photosensitive member having the electrostatic latent image formed thereon, so that the electrostatic latent image is visualized to form a toner image. After transferred directly onto a paper sheet or indirectly onto a paper sheet via an intermediate transfer member, this toner image is heated and pressed by a fixing unit, to form an image on the paper sheet.

An image forming apparatus includes rotating members such as photosensitive members and developer carriers as the components for image formation. It is known that periodical density fluctuations in the image sub-scan direction occur due to rotational deflection of those rotating members. For example, the distance (a development gap) between a photosensitive member and a developer carrier periodically changes due to rotational deflection of the photosensitive member or the developer carrier. Because of this, the field intensity periodically varies, even when a constant developing bias is applied. As a result, density fluctuations occur in images in the same cycles as the rotation cycles of the photosensitive member or the developer carrier. Hereinafter, periodical density fluctuations that occur in the image sub-scan direction will be referred to as "periodical density unevenness".

In a conventional image forming apparatus, correction data corresponding to the rotation position (the phase based on the home position) of a photosensitive member is created in accordance with a density profile indicating periodical density unevenness, so that the periodical density unevenness can be eliminated. With this correction data, image forming conditions such as the exposure energy (exposure time or exposure power), the charging voltage, the developing bias voltage, and the number of rotations of a developer carrier (a developing roller, for example), and the density value (tone value) of input image data are corrected (see JP 2014-219453 A).

A density profile is created by forming a density correction patch image (a halftone image having a halftone density, for example) on a toner image carrier such as an intermediate transfer belt, and detecting the image density in the correction patch image. This correction patch image is formed so that the length in the sub-scan direction becomes greater than the greatest cycle length (normally, the cycle length of a photosensitive member) among the cycle lengths (equivalent to the rotation periods) of rotating members that might cause periodical density unevenness. Alternatively, a correction patch image that is longer than a multiple of the cycle length of a rotating member is formed, and the mean value of detected image densities is calculated. In this manner, a high-precision density profile can be obtained.

To increase density correction accuracy, the density profile is preferably updated regularly or at a predetermined time such as the start of a print job. This is because the density profile changes as the development and transfer characteristics change with environments or with the passage of time.

If the length of the correction patch image in the sub-scan direction is increased, or if the density profile is frequently updated, density correction accuracy is increased, but the following problems are caused: the load to be imposed on the cleaning unit when the correction patch image formed on the toner image carrier is removed becomes larger; the amount of toner to be consumed in the density correction becomes larger; and a longer period of time is required for the density correction, resulting in a decrease in productivity, for example.

SUMMARY OF THE INVENTION

An object of the present invention is to provide an image forming apparatus capable of efficiently correcting periodical density unevenness.

To achieve the abovementioned object, according to an aspect, an image forming apparatus reflecting one aspect of the present invention comprises: an image forming unit including a rotating member as a component, the image forming unit being configured to form an image on a paper sheet in accordance with print job data; a rotation position detecting unit configured to detect a rotation position of the rotating member; an image density detecting unit configured to detect a density in an image formed on an image carrier by the image forming unit; an image information analyzing unit configured to analyze image information included in the print job data; a density profile managing unit configured to form a correction patch image on the image carrier, and create and manage a density profile indicating periodical density unevenness in accordance with a result of the detection performed by the image density detecting unit with respect to the correction patch image; a correction data creating unit configured to create correction data corresponding to the rotation position of the rotating member in accordance with the density profile; a density correcting unit configured to perform density correction using the correction data; and a density correction control unit configured to predict an appearance of periodical density unevenness in accordance with image information about the image to be formed, and set conditions for the density correction in accordance with a result of the prediction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 8 shows an example of a reference image determining table.

DESCRIPTION OF THE PREFERRED EMBODIMENTS

Hereinafter, an embodiment of the present invention will be described in detail with reference to the drawings. However, the scope of the invention is not limited to the illustrated examples.

Figure 1:
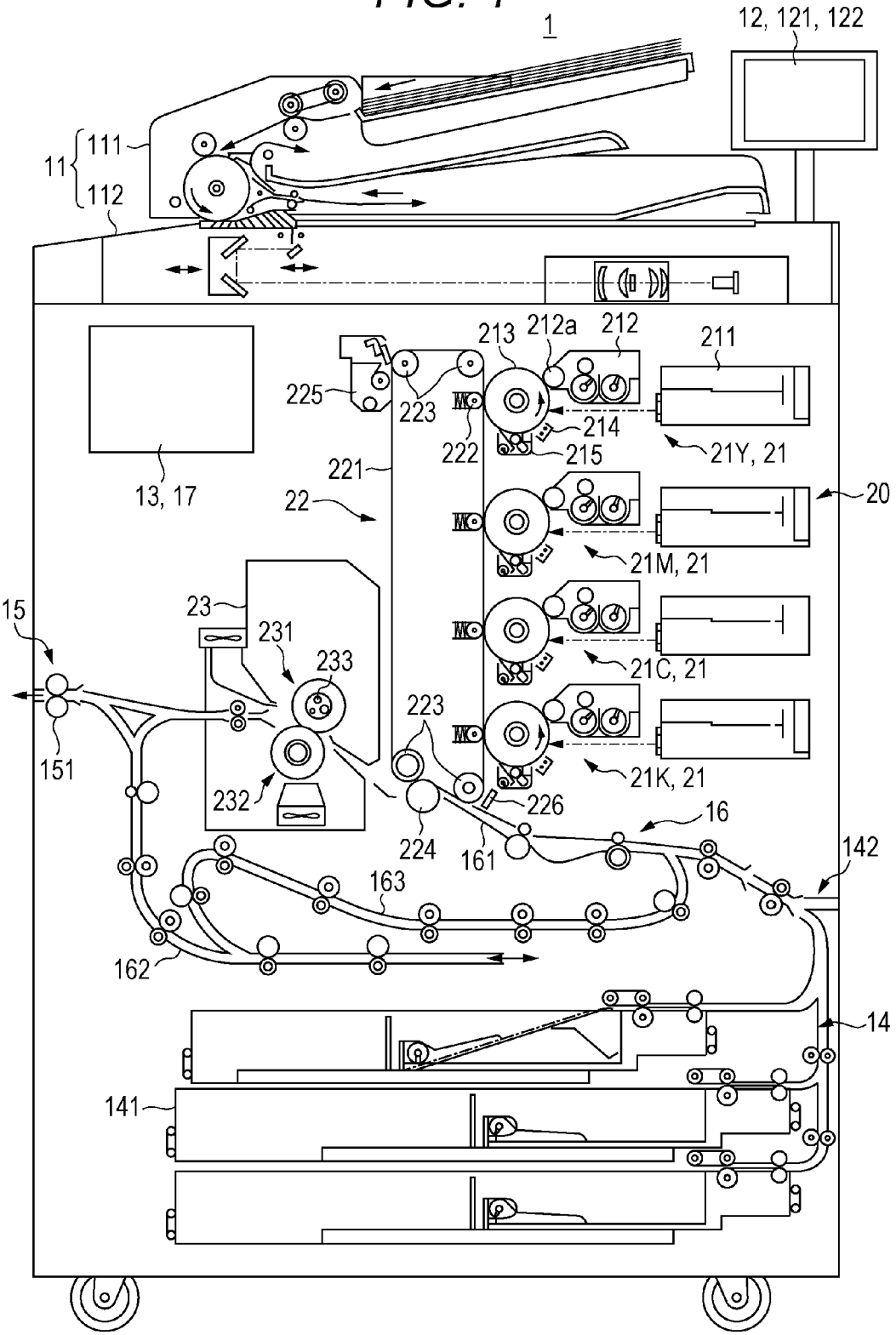
FIG. 1 is a diagram showing the structure of an entire image forming apparatus.
Figure 2:
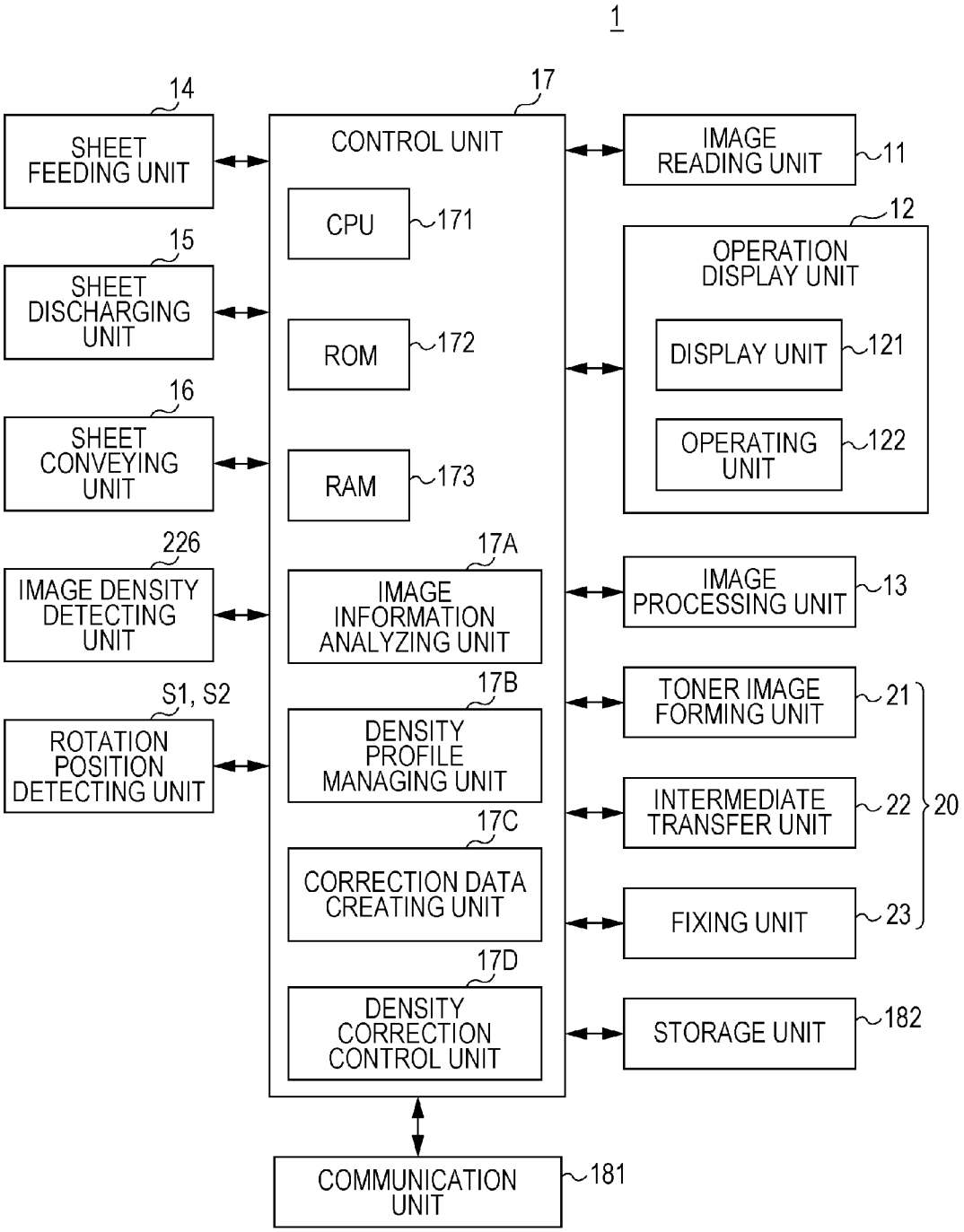
FIG. 2 is a diagram showing the principal components of the control system of the image forming apparatus.

FIG. 1 is a diagram showing the structure of an entire image forming apparatus 1. FIG. 2 is a diagram showing the principal components of the control system of the image forming apparatus 1.

The image forming apparatus 1 shown in FIGS. 1 and 2 is a color image forming apparatus of an intermediate transfer type using an electrophotographic process technology. In the image forming apparatus 1, a vertical tandem system is employed so that photosensitive drums 213 corresponding to the four colors of CMYK are arranged in series in the conveying direction of an intermediate transfer belt 221 (the vertical direction), and toner images in the respective colors are transferred onto the intermediate transfer belt 221 by one operation.

Specifically, the image forming apparatus 1 performs a primary transfer of toner images in the respective colors of Y (yellow), M (magenta), C (cyan), and K (black) from the photosensitive drum 213 onto the intermediate transfer belt 221, and overlaps the toner images in the four colors on one another on the intermediate transfer belt 221. After that, the image forming apparatus 1 performs a secondary transfer of the toner images onto a paper sheet, to form an image.

As shown in FIGS. 1 and 2, the image forming apparatus 1 includes an image reading unit 11, an operation display unit 12, an image processing unit 13, an image forming unit 20, a sheet feeding unit 14, a sheet discharging unit 15, a sheet conveying unit 16, and a control unit 17.

The control unit 17 includes a CPU (Central Processing Unit) 171, a ROM (Read Only Memory) 172, and a RAM (Random Access Memory) 173. The CPU 171 reads a program in accordance with the purpose of processing from the ROM 172 or a storage unit 182, and loads the program into the RAM 173. In conjunction with the loaded program, the CPU 171 controls operation of each block of the image forming apparatus 1 in a centralized manner.

The control unit 17 performs transmission and reception of various kinds of data to and from an external device (a personal computer, for example) connected to a communication network such as a LAN (Local Area Network) or a WAN (Wide Area Network) via a communication unit 181. For example, the control unit 17 receives print job data transmitted from an external device, and creates input image data in accordance with this print job data. The print job data is written in a predetermined page description language (PDL), and contains data of an image object formed with a figure or a photograph, for example, and data of a text object formed with characters and symbols, for example.

The control unit 17 functions as an image information analyzing unit 17A, a density profile managing unit 17B, a correction data creating unit 17C, and a density correction control unit 17D.

The communication unit 181 includes various kinds of interfaces such as an NIC (Network Interface Card), a MODEM (MOdulator-DEModulator), and a USB (Universal Serial Bus), to enable itself to perform information communication with external devices.

The storage unit 182 is formed with a nonvolatile semiconductor memory (a so-called flash memory) or a hard disk drive, for example. The storage unit 182 stores a look-up table or the like that is referred to when operation of each block is controlled, for example.

The image reading unit 11 includes an automatic document feeding device 111 called an ADF (Auto Document Feeder) and a document image scanning device 112 (a scanner).

The automatic document feeding device 111 conveys a document placed on a document tray with a conveyance mechanism, to send the document to the document image scanning device 112. By virtue of the automatic document feeding device 111, images of a large number of documents placed on the document tray can be consecutively read.

The document image scanning device 112 optically scans a document conveyed onto a contact glass from the automatic document feeding device 111 or a document placed on the contact glass, and forms an image on the light receiving surface of a CCD (Charge Coupled Device) sensor with light reflected from the document. In this manner, a document image is read. The image reading unit 11 generates input image data in accordance with a result of the reading performed by the document image scanning device 112. This input image data is subjected to predetermined image processing at the image processing unit 13.

The operation display unit 12 is formed with a liquid crystal display (LCD) having a touch panel, for example, and functions as a display unit 121 and an operating unit 122.

The display unit 121 displays various operation screens, conditions of images, operating conditions of respective functions, and the like, in accordance with display control signals that are input from the control unit 17.

The operating unit 122 includes various kinds of operation keys such as a numeric keypad and a start key, to receive various input operations from users and output operating signals to the control unit 17. By operating the operation display unit 12, a user can also perform setting related to image formation such as document setting, image quality setting, magnification setting, application setting, output setting, and paper sheet setting.

The image processing unit 13 includes a circuit or the like that performs digital image processing on input image data in accordance with initial settings or user settings. For example, the image processing unit 13 performs tone correction in accordance with tone correction data under the control of the control unit 17. The image processing unit 13 also performs various correction processes such as color correction and shading correction on the input image data. The image forming unit 20 is controlled in accordance with the image data subjected to those processes.

The image processing unit 13 further functions as a density correcting unit, and performs density correction using correction data created by the correction data creating unit 17C. Specifically, the image processing unit 13 corrects image forming conditions such as the exposure energy (exposure time or exposure power), the charging voltage, the developing bias voltage, and the number of rotations of a developer carrier 212*a*, or the density value (tone value) of input image data.

The image forming unit 20 includes: a toner image forming unit 21 that forms toner images in the respective color toners of the Y component, the M component, the C component, and the K component, in accordance with input image data; an intermediate transfer unit 22 that transfers the toner images formed by the toner image forming unit 21 onto a paper sheet; and a fixing unit 23 that fixes the toner images transferred onto the paper sheet.

The toner image forming unit 21 is formed with four toner image forming units 21Y, 21M, 21C, and 21K for the Y component, the M component, the C component, and the K component. Since the toner image forming units 21Y, 21M, 21C, and 21K have the same structures, like structural elements are denoted by like reference numerals for ease of explanation and simplification of illustration in the drawings, and Y, M, C, or K is attached to each reference numeral where there is a need for a distinction. In FIG. 1, only the structural elements of the toner image forming unit 21Y for the Y component are denoted by reference numerals, while the structural elements of the other toner image forming units 21M, 21C, and 21K are not.

Each toner image forming unit 21 includes an exposure device 211, a developing device 212, a photosensitive drum 213, a charging device 214, a drum cleaning device 215, and the like. Each toner image forming unit 21 may include a neutralization device that removes residual charge remaining on the surface of the photosensitive drum 213 after the primary transfer.

The photosensitive drum 213 is an organic photoconductor (OPC) of a negative charge type that is formed by sequentially stacking an undercoat layer (UCL), a charge generation layer (CGL), and a charge transport layer (CTL) on the peripheral surface of a conductive cylinder made of aluminum (an aluminum tube), for example. The charge generation layer is formed with an organic semiconductor containing a charge generating material (phthalocyanine pigment, for example) dispersed in a resin binder (polycarbonate, for example), and generates a pair of a positive charge and a negative charge upon exposure performed by the exposure device 211. The charge transport layer is formed by dispersing a hole transporting material (an electron donating nitrogen-containing compound) in a resin binder (a polycarbonate resin, for example), and transports the positive charge generated in the charge generation layer to the surface of the charge transport layer.

A home position mark indicating a reference position is formed on the photosensitive drum 213, and a sensor S1 (a rotation position detecting unit shown in FIG. 2) is provided in the proximity of the photosensitive drum 213. In accordance with the time elapsed since the home position mark was detected by the sensor S1, the rotation position of the photosensitive drum 213 is determined.

The charging device 214 is formed with a corona discharger, such as a scorotron charger or a corotron charger. The photosensitive drum 213 is uniformly charged by the charging device 214, to have the negative polarity.

The exposure device 211 is formed with an LED print head that includes an LED array in which light-emitting diodes (LEDs) are linearly arranged, an LPH driving unit (a driver IC) for driving the respective LEDs, and a lens array that gathers light emitted from the LED array and forms an image on the photosensitive drum 213, for example. One LED of the LED array corresponds to one dot in an image.

The exposure device 211 illuminates the photosensitive drum 213 with light in accordance with an image of the corresponding color component. As the positive charge generated in the charge generation layer of the photosensitive drum 213 illuminated with light is transported to the surface of the charge transport layer, the surface charge (the negative charge) of the photosensitive drum 213 is neutralized. As a result, an electrostatic latent image of the corresponding color component is formed on the surface of the photosensitive drum 213 by virtue of a potential difference from the surrounding area.

The developing device 212 houses a developer (a two-component developer formed with a toner and magnetic carriers) for the corresponding color component, and forms a toner image by applying the toner of the corresponding color to the surface of the photosensitive drum 213 and visualizing the electrostatic latent image. Specifically, a developing bias voltage is applied to the developer carrier 212*a* (a developing roller, for example), so that an electrical field is formed between the photosensitive drum 213 and the developer carrier 212*a*. Due to the potential difference between the photosensitive drum 213 and the developer carrier 212*a*, the charged toner on the developer carrier 212*a* moves to the exposed portion of the surface of the photosensitive drum 213, and adheres thereonto.

A home position mark indicating a reference position is formed on the developer carrier 212*a*, and a sensor S2 (a rotation position detecting unit shown in FIG. 2) is provided in the proximity of the developer carrier 212*a*. In accordance with the time elapsed since the home position mark was detected by the sensor S2, the rotation position of the developer carrier 212*a* is determined.

The drum cleaning device 215 includes a drum cleaning blade or the like that is in contact with and slides on the surface of the photosensitive drum 213, and removes untransferred toner remaining on the surface of the photosensitive drum 213 after the primary transfer.

The intermediate transfer unit 22 includes the intermediate transfer belt 221, primary transfer rollers 222, supporting rollers 223, a secondary transfer roller 224, and a belt cleaning device 225.

The intermediate transfer belt 221 is formed with an endless belt, and is stretched in the form of a loop by the supporting rollers 223. At least one of the supporting rollers 223 is a driving roller, and the other ones are following rollers. As the driving roller rotates, the intermediate transfer belt 221 moves at a constant speed.

The primary transfer rollers 222 are placed on the inner peripheral surface side of the intermediate transfer belt 221, facing the photosensitive drums 213 of the respective color components. As the primary transfer rollers 222 are pressed against the photosensitive drums 213 with the intermediate transfer belt 221 interposed in between, primary transfer nips for transferring toner images from the photosensitive drums 213 onto the intermediate transfer belt 221 are formed (the primary transfer nips will be hereinafter referred to as the "primary transfer portions").

The secondary transfer roller 224 is located on the outer peripheral surface side of the intermediate transfer belt 221, facing one of the supporting rollers 223. Of the supporting rollers 223, the supporting roller 223 facing the intermediate transfer belt 221 is called the backup roller. As the secondary transfer roller 224 is pressed against the backup roller with the intermediate transfer belt 221 interposed in between, a secondary transfer nip for transferring a toner image from the intermediate transfer belt 221 onto a paper sheet is formed (the secondary transfer nip will be hereinafter referred to as the "secondary transfer portion"). The secondary transfer roller 224 may be replaced with a structure (a belt-type secondary transfer unit) having a secondary transfer belt stretched in the form of a loop by supporting rollers including a secondary transfer roller.

At the primary transfer portion, the toner images on the photosensitive drums 213 are sequentially transferred onto the intermediate transfer belt 221 in an overlapping manner. Specifically, a primary transfer bias is applied to each primary transfer roller 222 to provide the back surface side (the side in contact with the primary transfer rollers 222) of the intermediate transfer belt 221 with charge of the opposite polarity from the polarity of the toner. In this manner, the toner images are electrostatically transferred onto the intermediate transfer belt 221.

When a paper sheet passes through the secondary transfer portion after that, the toner image on the intermediate transfer belt 221 is transferred onto the paper sheet. Specifically, a secondary transfer bias is applied to the secondary transfer roller 224 to provide the back surface side (the side in contact with the secondary transfer roller 224) of the paper sheet with charge of the opposite polarity from the polarity of the toner. In this manner, the toner image is electrostatically transferred onto the paper sheet. The paper sheet having the toner image transferred thereonto is then conveyed toward the fixing unit 23.

The belt cleaning device 225 includes a belt cleaning blade or the like that is in contact with and slides on the surface of the intermediate transfer belt 221, and removes untransferred toner remaining on the surface of the intermediate transfer belt 221 after the secondary transfer. The correction patch image that was formed on the intermediate transfer belt 221 when the density profile was created is removed by the belt cleaning device 225.

On the downstream side of the primary transfer portion in the belt moving direction, an image density detecting unit 226 that detects the density in the toner image formed on the intermediate transfer belt 221 is provided in a region on the upstream side of the secondary transfer portion in the belt moving direction.

The image density detecting unit 226 includes a light emitting element such as a light emitting diode (LED) and a light receiving element such as a photodiode (PD). The image density detecting unit 226 is formed with a reflected light sensor that detects the intensity of light reflected from a toner image. The image density detecting unit 226 is used when a density profile is created, and when the density profile is updated. The image density detecting unit 226 may be a line sensor, for example.

The fixing unit 23 includes an upper fixing unit 231 that has a fixing surface side member placed on the fixing surface side (the side on which a toner image is formed) of a paper sheet, a lower fixing unit 232 that has a back surface side supporting member placed on the back surface side (the opposite side from the fixing surface) of the paper sheet, a heat source 233 that heats the fixing surface side member, and a pressing/separating unit (not shown) that presses the back surface side supporting member against the fixing surface side member.

A fixing roller serves as the fixing surface side member in a case where the upper fixing unit 231 is of a roller heating type, and a fixing belt serves as the fixing surface side member in a case where the upper fixing unit 231 is of a belt heating type, for example. A pressure roller serves as the back surface side supporting member in a case where the lower fixing unit 232 is of a roller pressure type, and a pressure belt serves as the back surface side supporting member in a case where the lower fixing unit 232 is of a belt pressure type, for example. In FIG. 1, the upper fixing unit 231 is of a roller heating type, and the lower fixing unit 232 is of a roller pressure type.

The upper fixing unit 231 includes an upper fixing unit driving unit (not shown) that causes the fixing surface side member to rotate. As the control unit 17 controls operation of the upper fixing unit driving unit, the fixing surface side member rotates (runs) at a predetermined speed. The lower fixing unit 232 includes a lower fixing unit driving unit (not shown) that causes the back surface side supporting member to rotate. As the control unit 17 controls operation of the lower fixing unit driving unit, the back surface side supporting member rotates (runs) at a predetermined speed. In a case where the fixing surface side member rotates following the rotation of the back surface side supporting member, the upper fixing unit driving unit is not necessary.

The heat source 233 is placed inside or in the vicinity of the fixing surface side member. The control unit 17 controls the output of the heat source 233 so that the fixing temperature becomes equal to a fixing control temperature, in accordance with results of detection performed by a fixing temperature detecting unit (not shown) placed in the vicinity of the fixing surface side member. As the control unit 17 controls the output of the heat source 233, the fixing surface side member is heated to and maintained at the fixing control temperature (a target fixing temperature or an idling temperature, for example).

The pressing/separating unit (not shown) presses the back surface side supporting member against the fixing surface side member. For example, the pressing/separating unit is in contact with both ends of the shaft supporting the back surface side supporting member, and presses the both ends of the shaft independently of each other. With this, the nip pressure balance in the axial direction at the fixing nip can be adjusted. As the control unit 17 controls operation of the pressing/separating unit (not shown), and the back surface side supporting member is pressed against the fixing surface side member, the fixing nip for nipping and conveying a paper sheet is formed.

A paper sheet that has a toner image transferred thereonto by the secondary transfer and has been conveyed through the sheet conveyance path is heated and pressed when passing through the fixing unit 23. As a result, the toner image is fixed onto the paper sheet.

The sheet feeding unit 14 includes a sheet feed tray 141 and a manual sheet feeder 142. Paper sheets (standard paper sheets or special paper sheets) sorted out in accordance with basis weights, sizes, and the like are housed in the sheet feed tray 141 on a paper type basis. Feeding roller units are provided in the sheet feed tray 141 and the manual sheet feeder 142. A large-capacity external sheet feeding device (not shown) can be connected to the manual sheet feeder 142. The sheet feeding unit 14 sends a paper sheet supplied from the sheet feed tray 141 or the manual sheet feeder 142 into the sheet conveying unit 16.

The sheet discharging unit 15 includes a discharging roller unit 151, for example, and discharges a paper sheet sent out from the sheet conveying unit 16 to the outside the apparatus.

The sheet conveying unit 16 includes a principal conveying unit 161, a switchback conveying unit 162, a back-surface print conveying unit 163, and a conveyance path switching unit (not shown). Part of the sheet conveying unit 16 is incorporated, together with the fixing unit 23, into one unit, for example, and is detachably attached mounted in the image forming apparatus 1.

The principal conveying unit 161 includes conveyance roller units such as a loop roller unit and a resist roller unit that serve as sheet conveying elements for nipping and conveying paper sheets. The principal conveying unit 161 conveys a paper sheet supplied from the sheet feed tray 141 or the manual sheet feeder 142 into the image forming unit 20 (the intermediate transfer unit 22 and the fixing unit 23), and conveys a paper sheet sent out from the image forming unit 20 (the fixing unit 23) toward the sheet discharging unit 15 or the switchback conveying unit 162.

The switchback conveying unit 162 suspends the conveyance of a paper sheet sent out from the fixing unit 23, reverses the conveying direction, and then conveys the paper sheet to the sheet discharging unit 15 or the back-surface print conveying unit 163.

The back-surface print conveying unit 163 conveys a paper sheet subjected to switchback at the switchback conveying unit 162, back to the principal conveying unit 161. Thus, the principal conveying unit 161 is fed with a paper sheet having its back surface serving as the image forming surface.

The conveyance path switching unit (not shown) switches sheet conveyance paths by discharging a paper sheet sent out from the fixing unit 23 as it is, reversing and then discharging the paper sheet, or conveying the paper sheet to the back-surface print conveying unit 163. Specifically, the control unit 17 controls operation of the conveyance path switching unit (not shown) in accordance with the details of an image forming process (such as one-side or two-side printing, or face-up or face-down discharging).

A paper sheet supplied from the sheet feeding unit 14 is conveyed to the image forming unit 20 by the principal conveying unit 161. When the paper sheet passes through the transfer nip, the toner images on the photosensitive drums 213 are collectively transferred onto a first surface (the front surface) of the paper sheet, and are subjected to a fixing process at the fixing unit 23. The paper sheet having an image formed thereon is then discharged to the outside of the apparatus by the sheet discharging unit 15. In a case where images are to be formed on both surfaces of a paper sheet, the paper sheet having an image formed on its first surface is sent to the switchback conveying unit 162, reverses by returning to the principal conveying unit 161 via the back-surface print conveying unit 163, and then has an image formed on its second surface (the back surface).

In the image forming apparatus 1, periodical density fluctuations (periodical density unevenness) occur in the sub-scan direction due to rotational deflection of rotating members such as the photosensitive drums 213 and the developer carriers 212*a*. The periodical density unevenness differs among tone levels, and also differs among the colors Y, M, C, and K. In view of this, the periodical density unevenness is corrected for each color component.

In the image forming apparatus 1, the control unit 17 functions as an image information analyzing unit 17A, a density profile managing unit 17B, a correction data creating unit 17C, and a density correction control unit 17D, to prevent periodical density unevenness in an image. Using the correction data created by the correction data creating unit 17C, the image processing unit 13 corrects the image forming conditions or the density value (tone value) of input image data. In this embodiment, the correction data is updated as necessary.

The image information analyzing unit 17A analyzes the image information about all the pages included in print job data (including image object data and text object data), and obtains the size information, the color information, the density information, and the page information about the images, and the size information about the paper sheets on which the images are to be formed.

The density profile managing unit 17B manages a density profile indicating density fluctuations in the sub-scan direction, by associating the phase in the density profile with the rotation positions of the rotating members (such as the photosensitive drums 213 or the developer carriers 212*a*) that are components of the image forming unit 20. The density profile is stored in the storage unit 182, for example.

Figure 3:
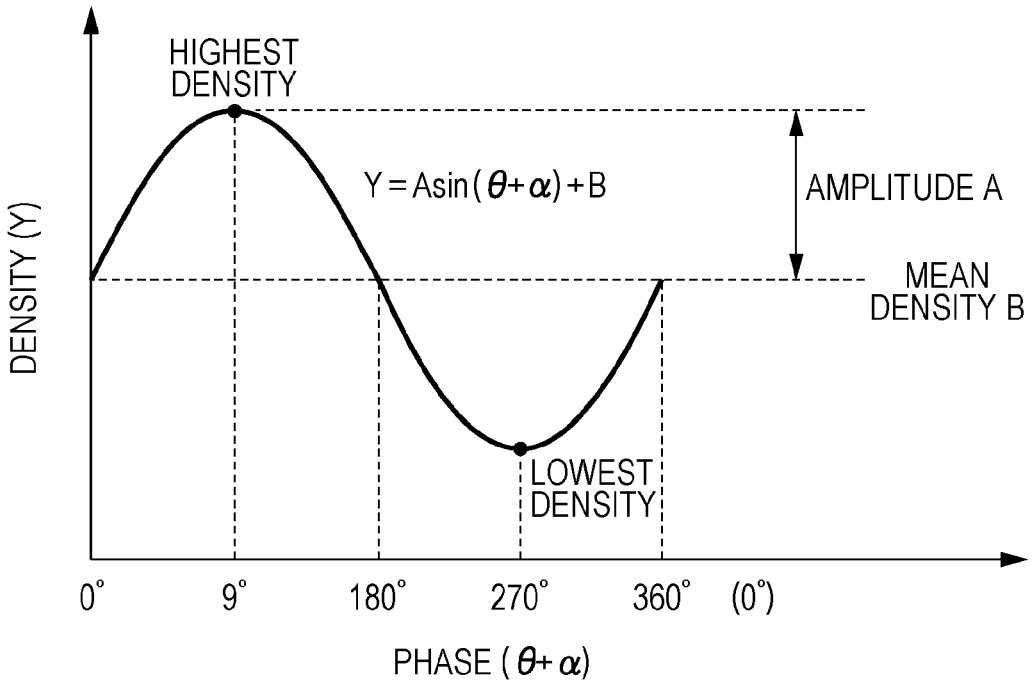
FIG. 3 is a graph showing an example of a density profile.

FIG. 3 is a graph showing an example of the density profile. As shown in FIG. 3, the density profile can be approximated by the sine curve, $Y=A\sin(\theta+\alpha)+B$. Here, A represents amplitude, $(\theta+\alpha)$ represents the phase of the density profile, and B represents the mean density. The density profile managing unit 17B manages density profiles like the one shown in FIG. 3 for the respective rotating members (such as the developer carriers 212*a* and the photosensitive drums 213 for the respective color components).

In a case where the correction data needs to be updated, the density profile managing unit 17B forms a density correction patch image on the intermediate transfer belt 221, and creates a new density profile in accordance with a result of detection performed by the image density detecting unit 226 with respect to the correction patch image. The correction patch image is a halftone image having a halftone density, for example. The length of the correction patch image in the sub-scan direction is set in accordance with the length of the later described reference image region in the sub-scan direction.

The correction data creating unit 17C creates the correction data corresponding to the rotation positions of the rotating members in accordance with the density profile, to eliminate periodical density unevenness. The correction data is stored in the storage unit 182, for example. If there is conspicuous periodical density unevenness in an image, the correction data is updated.

The density correction control unit 17D predicts an appearance of periodical density unevenness in accordance with the image information about the image to be formed, and sets the conditions for density correction in accordance with a result of the prediction. The conditions for density correction include the necessity/unnecessity to update the correction data, and the sub-scan-direction length of the correction patch image to be used in updating the correction data, for example.

If conspicuous periodical density unevenness in an image is predicted in the image forming apparatus 1, a new density profile is created in accordance with the image density in the correction patch image, and density correction is performed with the correction data created in accordance with the new density profile. If any conspicuous periodical density unevenness in an image is not predicted, on the other hand, the correction data is not updated, and density correction is performed with the existing correction data. The existing correction data is the correction data that is already stored at the start of a print job, and, in the initial state, is the correction data created in accordance with the fluctuation data inherent to the rotating members. Specifically, the density correction is performed according to the flowchart shown in FIG. 4.

Figure 4:
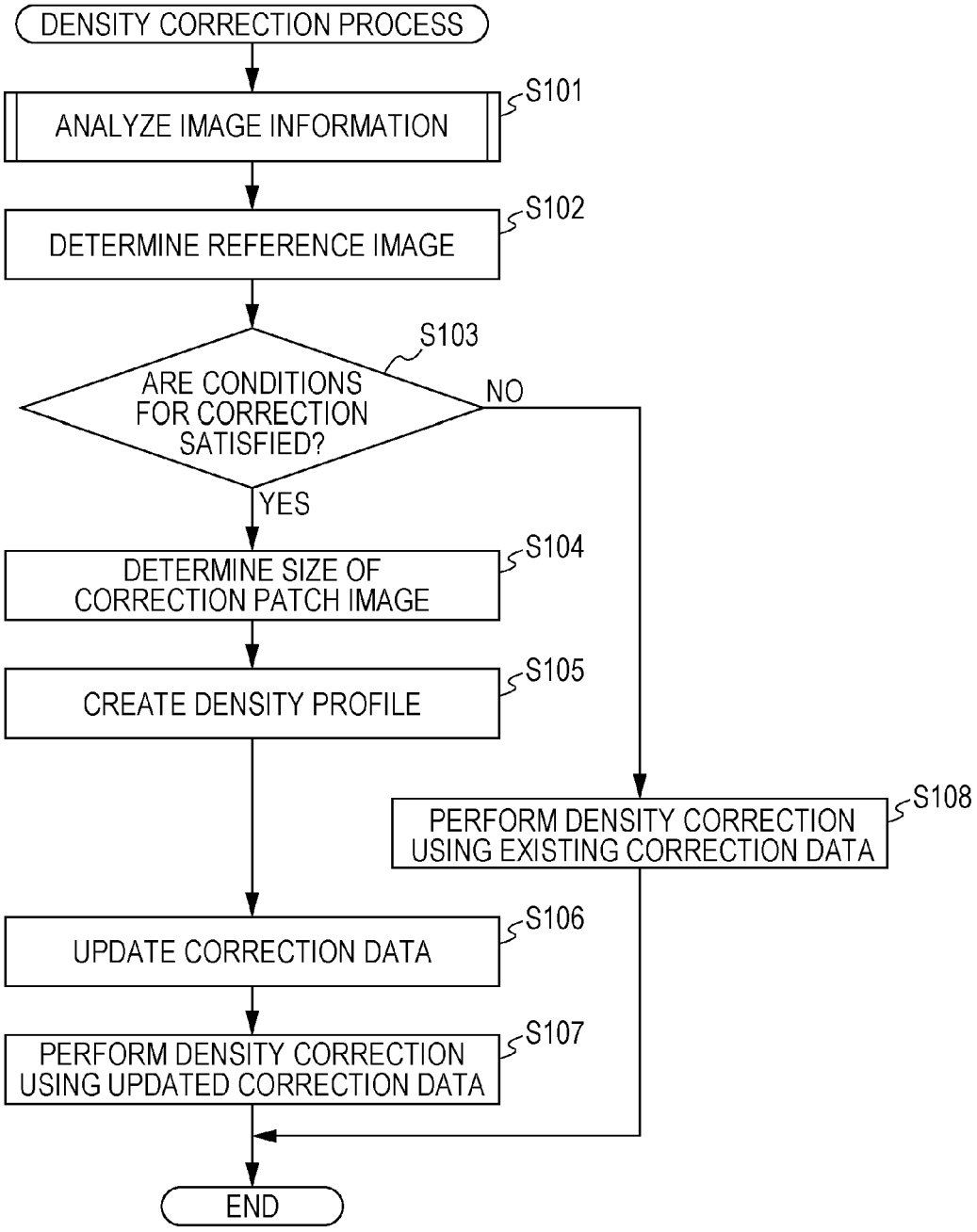
FIG. 4 is a flowchart showing an example of a density correction process.

FIG. 4 is a flowchart showing an example of a density correction process. This process is performed, as the CPU 171 executes a predetermined program stored in the ROM 172 when the image forming apparatus 1 receives print job data, for example. The cycle length b of each photosensitive drum 213 is approximately three times greater than the cycle length a of each developer carrier 212*a*.

Figure 5:
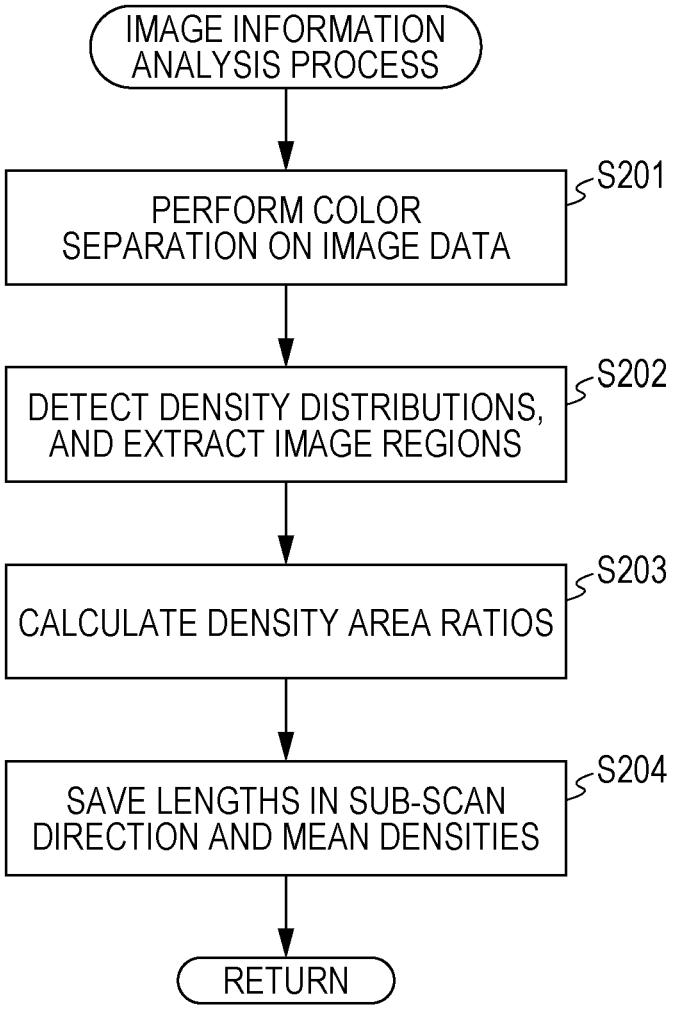
FIG. 5 is a flowchart showing part of the density correction process shown in FIG. 4.

In step S101, the control unit 17 analyzes the image information about all the pages included in the print job data, and obtains the size information, the color information, the density information, and the page information about the images, and the size information about the paper sheets on which the images are to be formed (the control unit 17 functioning as the image information analyzing unit 17A). The image information analysis is carried out according to the flowchart shown in FIG. 5, for example.

Figure 6:
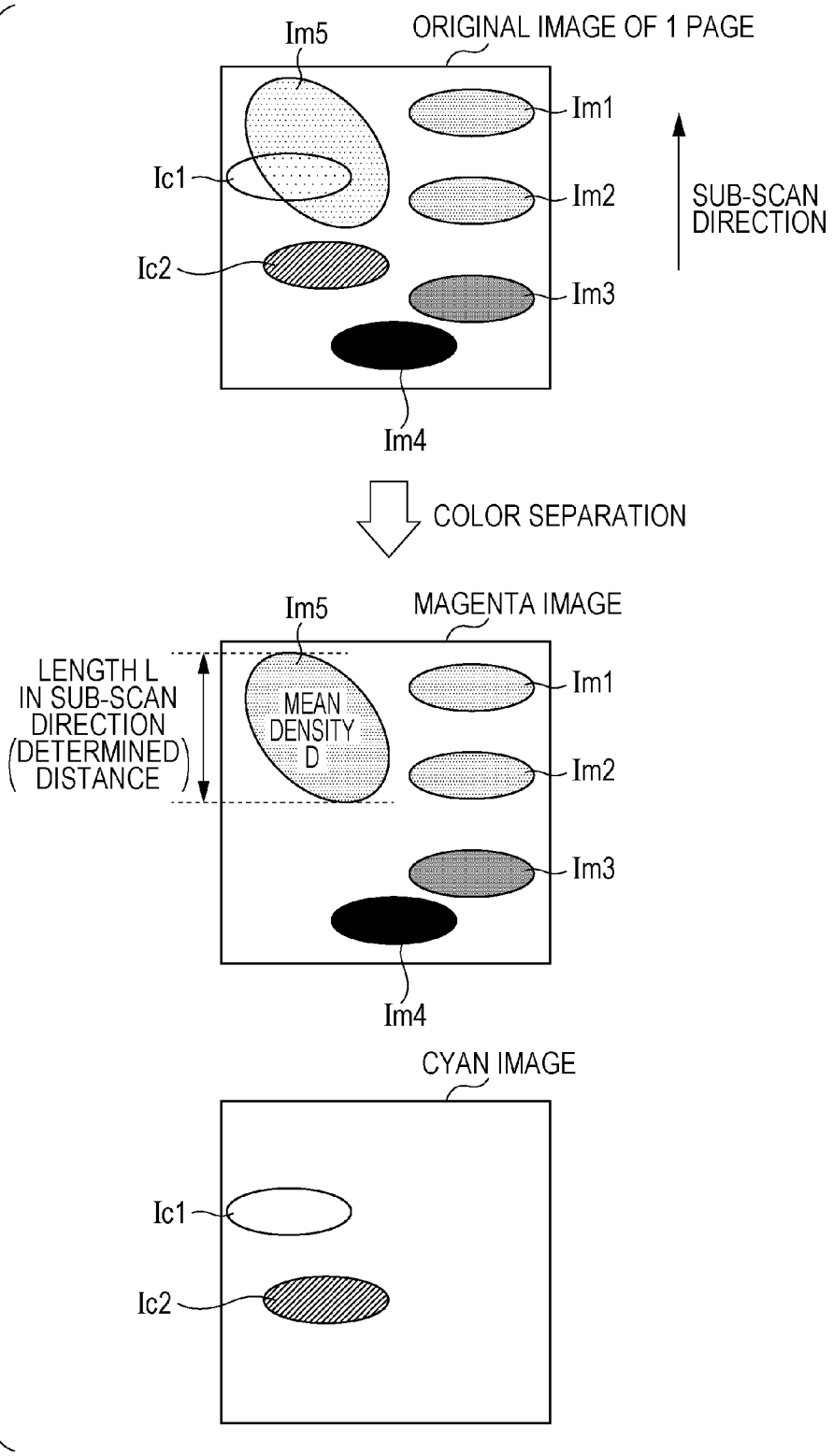
FIG. 6 is a diagram showing color separation to be performed on an original image.

Specifically, in step S201, the control unit 17 separates the image data of all the pages into the respective color components. For example, in a case where the original image is formed with magenta and cyan, as shown in FIG. 6, the image is divided into a magenta color image and a cyan color image. Conditions for density correction are then set for each of the separate color images.

In step S202, the control unit 17 detects density distributions from the respective color images, and extracts image regions. An image region is a region that can be clearly distinguished from the background region where the density is 0. For example, a portion in which pixels having higher densities than 0 exist in a successive manner (or a portion in which such pixels gather at a certain density) is extracted as one image region. Each image region is normally formed with pixels having different densities. For example, in the magenta image shown in FIG. 6, image regions Im1 through Im5 are extracted. In the cyan image shown in FIG. 6, image regions Ic1 and Ic2 are extracted.

Figure 7:
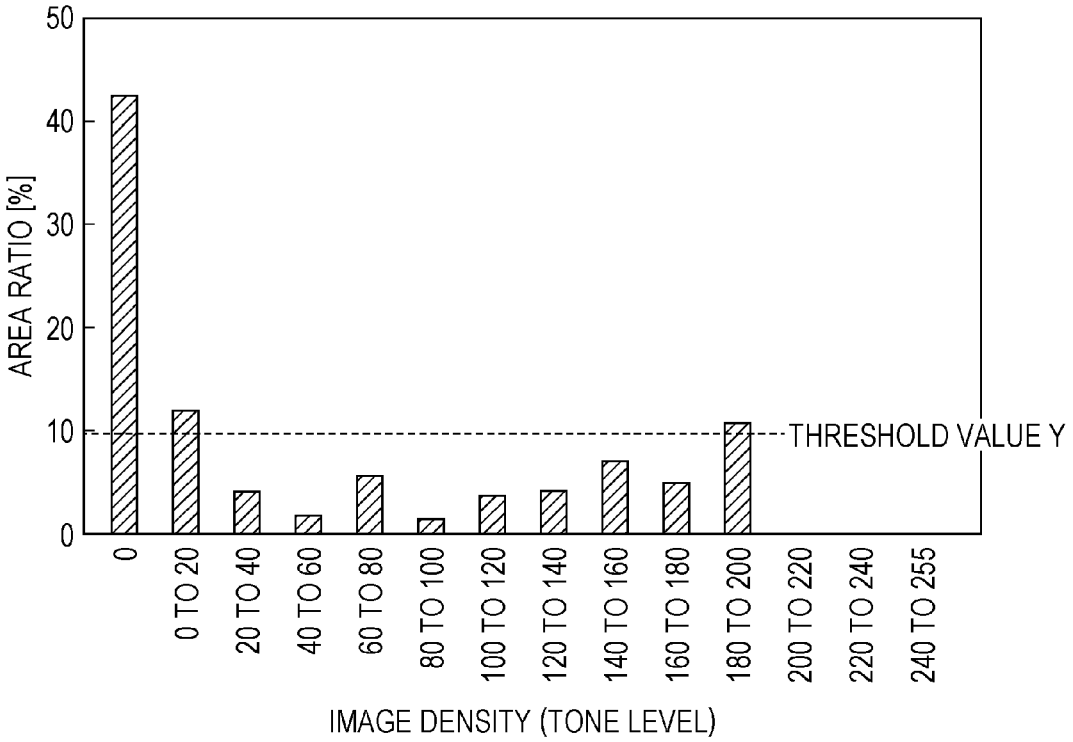
FIG. 7 is a graph showing examples of area ratios of image densities.

In step S203, the control unit 17 calculates density area ratios of the respective color images (see FIG. 7). An area ratio is the ratio of the pixel area in a predetermined density range to the image area in all the pages.

In step S204, the control unit 17 calculates the length L (hereinafter referred to as the "determined distance L") of each of the extracted image regions in the sub-scan direction and the mean density D in each of the extracted image regions, and then stores the determined distances L and the mean densities D. The conditions for density correction are set in accordance with the information obtained in this image information analysis process. When step S204 is completed, the process moves on to the main process shown in FIG. 4.

The procedures in step S102 and the following steps in FIG. 4 are carried out for each of the color components. In step S102, the control unit 17 compares the image regions extracted from each color image, and determines a reference image region (the control unit 17 functioning as the density correction control unit 17D). The reference image region is the image region to be used for setting the conditions for density correction, and is the image region that is considered likely to have the most conspicuous periodical density unevenness.

For example, determination values are calculated in accordance with the determined distances L and the mean densities D of the image regions shown in a reference image determining table. In the reference image determining table, a greater determination value is set for a mean density D closer to the reference density C and a longer determined distance L. The reference density C is an image density at which periodical density unevenness is likely to appear, and is set as appropriate.

FIG. 8 shows an example of the reference image determining table. According to the reference image determining table shown in FIG. 8, the determination value for an image region having a determined distance L expressed as "$a<L\leq 2a$" (a: the cycle length of the developer carrier 212*a*) and a mean density D expressed as "$C-10\leq D<C+10$" is "7". The image region having the greatest determination value is set as the reference image region.

In step S103, the control unit 17 determines whether the conditions for performing correction are satisfied, in accordance with the information obtained in step S101 (the control unit 17 functioning as the density correction control unit 17D). If the conditions for performing correction are satisfied ("YES" in step S103), the process moves onto step S104. If the conditions for performing correction are not satisfied ("NO" in step S103), the process moves on to step S108. The conditions for performing correction are the conditions under which conspicuous periodical density unevenness can be actually predicted.

For example, the conditions for performing correction are satisfied when (1) the determined distance L of the reference image region is equal to or greater than a threshold value Z (or is equal to or greater than the cycle length a of the developer carrier 212*a*, for example), (2) the difference between the mean density D and the reference density C is equal to or smaller than a threshold value X (or is equal to or smaller than 20 intone level, for example), and (3) the area ratio of the mean density D is equal to or higher than a threshold value Y (see FIG. 7).

In a case where periodical density unevenness appears but extends less than one cycle, and the difference between the mean density D and the reference density C is greater than the threshold value X, the periodical density unevenness is inconspicuous. If the area ratio of the mean density D is lower than the threshold value Y, periodical density unevenness appears only locally, if any, and image quality does not degrade in the entire image. In such a case, the degree of necessity to update the correction data is low.

If at least one of the above conditions (1) through (3) is satisfied, the conditions for performing correction may be determined to be satisfied.

In step S104, the control unit 17 determines the size (the length in the sub-scan direction) of the correction patch image (the control unit 17 functioning as the density correction control unit 17D). The size of the correction patch image is preferably as small as possible within such a range that periodical density unevenness likely to appear in the reference image region can be corrected.

In a case where the determined distance L of the reference image region is equal to or greater than the cycle length b of the photosensitive drum 213, for example, periodical density unevenness due to rotational deflection of the photosensitive drum 213 and the developer carrier 212*a* is likely to appear in the reference image region. In view of this, the size of the correction patch image is made equal to the cycle length b of the photosensitive drum 213. In a case where the determined distance L of the reference image region is smaller than the cycle length b of the photosensitive drum 213, for example, periodical density unevenness due to rotational deflection of the photosensitive drum 213 is not likely to appear in the reference image region, but periodical density unevenness due to rotational deflection of the developer carrier 212*a* is likely to appear. In view of this, the size of the correction patch image is made equal to the cycle length a of the developer carrier 212*a*.

In step S105, the control unit 17 creates a new density profile, using the determined correction patch image (the control unit 17 functioning as the density profile managing unit 17B). Since the correction patch image of an appropriate size is set in accordance with the reference image region, the load to be imposed on the belt cleaning device 225 by density correction can be reduced, and the amount of toner to be consumed in the density correction can also be reduced.

In step S106, the control unit 17 updates the correction data in accordance with the density profile (the control unit 17 functioning as the correction data creating unit 17C).

In step S107, the control unit 17 instructs the image processing unit 13 to perform density correction using the updated correction data. Consequently, periodical density unevenness likely to appear in the image to be formed can be corrected.

In step S108, the control unit 17 does not update the correction data, and instructs the image processing unit 13 to perform density correction using the existing correction data. Consequently, the load to be imposed on the belt cleaning device 225 by density correction can be reduced, and the amount of toner to be consumed in the density correction can also be reduced.

As described above, the image forming apparatus 1 includes: the image forming unit 20 that includes the photosensitive drums 213 and the developer carriers 212*a* (rotating members) as components, and forms an image on a paper sheet in accordance with print job data; the rotation position detecting unit that detects the rotation positions of the photosensitive drums 213 and the developer carriers 212*a*; the image density detecting unit 226 that detects the density in an image formed on the intermediate transfer belt 221 (the image carrier) by the image forming unit 20; the image information analyzing unit 17A that analyzes the image information included in the print job data; the density profile managing unit 17B that forms a correction patch image on the intermediate transfer belt 221, and creates and manages a density profile indicating periodical density unevenness in accordance with a result of detection performed by the image density detecting unit 226 with respect to the correction patch image; the correction data creating unit 17C that creates the correction data corresponding to the rotation positions of the photosensitive drums 213 and the developer carriers 212*a* in accordance with the density profile; the image processing unit 13 (the density correcting unit) that performs density correction using the correction data; and the density correction control unit 17D that predicts an appearance of periodical density unevenness in accordance with the image information about the image to be formed, and sets the conditions for the density correction (the necessity/unnecessity to update the correction data, the length of the correction patch image, and the like) in accordance with a result of the prediction.

In the image forming apparatus 1, an appearance of periodical density unevenness is predicted. If there is a possibility of an appearance of conspicuous periodical density unevenness, a density profile indicating the current periodical density unevenness is created as necessary, and the correction data is updated in accordance with this new density profile. Thus, the current periodical density unevenness can be corrected with precision.

In a case where there is no conspicuous periodical density unevenness in the image, the existing correction data is used, and any unnecessary correction patch image is not formed. Accordingly, the load to be imposed on the belt cleaning device 225 and the amount of toner to be consumed in density correction can be reduced. Furthermore, a decrease in productivity can be prevented.

Although the present invention made by the present inventor has been described in detail through an embodiment, the present invention is not limited to the above described embodiment, and changes may be made to the embodiment without departing from the scope of the invention.

For example, a correction patch image having a length equivalent to a multiple of the cycle length of the subject rotating member may be used, and a density profile may be created by calculating the mean value of the results of detection performed by the image density detecting unit 226. In this manner, the accuracy of the density profile is increased, and periodical density unevenness can be corrected with higher precision.

Further, the length of the correction patch image may be changed in accordance with the conspicuousness of periodical density unevenness (or the determined distance L). Alternatively, the length of the determined distance L may be changed depending on whether to put priority on correction accuracy or on whether to put priority on productivity.

In a case where image regions can be clearly recognized, but overlap in the main-scan direction and are located close to each other at a short distance (equal to or smaller than half the cycle length a of each developer carriers 212*a*, for example), periodical density unevenness appears over two image regions, resulting in conspicuousness. In view of this, an appearance of periodical density unevenness may be predicted by regarding these image regions as one image region. In FIG. 6, for example, the image regions Im3 and Im4 can be regarded as one image region.

In the embodiment, a halftone image is used as the correction patch image. However, a gradation pattern may be used as the correction patch image, to cope with differences in density unevenness among tone levels.

The present invention can also be applied to image forming apparatuses that form images on long paper such as roll paper, or monochrome image forming apparatuses. Further, the present invention can be applied in cases where periodical density unevenness caused by rotating members (such as the primary transfer rollers 222) other than the photosensitive drums 213 and the developer carriers 212*a* is to be corrected.

According to an embodiment of the present invention, an appearance of periodical density unevenness is predicted in accordance with image information, and the conditions for density correction (such as updating of the correction data and the length of the correction patch image) are determined in accordance with a result of the prediction. In this manner, the operation to be performed to create the density profile using the correction patch image and update the correction data is minimized. Thus, the load to be imposed on the cleaning unit and the amount of toner to be consumed in density correction can be reduced, and a decrease in productivity can be prevented. Furthermore, periodical density unevenness can be efficiently corrected.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include all modifications within the meaning and range equivalent to the scope of the claims.

What is claimed is:

1. An image forming apparatus comprising:

an image forming unit including a rotating member as a component, the image forming unit being configured to form an image on a paper sheet in accordance with print job data;

a rotation position detecting unit configured to detect a rotation position of the rotating member;

an image density detecting unit configured to detect a density in an image formed on an image carrier by the image forming unit;

an image information analyzing unit configured to analyze image information included in the print job data;

a density profile managing unit configured to form a correction patch image on the image carrier, and create and manage a density profile indicating periodical density unevenness in accordance with a result of the detection performed by the image density detecting unit with respect to the correction patch image;

a correction data creating unit configured to create correction data corresponding to the rotation position of the rotating member in accordance with the density profile;

a density correcting unit configured to perform density correction using the correction data; and a density correction control unit configured to predict an appearance of periodical density unevenness in accordance with image information about the image to be formed, and set conditions for the density correction in accordance with a result of the prediction;

wherein the density correction control unit extracts image regions from the image, determines a reference image region in accordance with lengths of the extracted image regions in a sub-scan direction and densities in the extracted image regions, and sets the conditions for the density correction in accordance with the length of the reference image region in the sub-scan direction and the density in the reference image region;

wherein, in accordance with the length of the reference image region in the sub-scan direction and the density in the reference image region, the density correction control unit determines whether to update the correction data; and wherein, when the length of the reference image region in the sub-scan direction is equal to or greater than a cycle length of the rotating member, and a difference between the density in the reference image region and a reference density is equal to or smaller than a predetermined threshold value, the density correction control unit updates the correction data.

2. The image forming apparatus according to claim 1, wherein the image information includes size information, color information, density information, and page information about the image included in the print job data, and size information about the paper sheet on which the image is to be formed.

3. The image forming apparatus according to claim 1, wherein, when the length of the reference image region in the sub-scan direction is equal to or greater than a cycle length of the rotating member, a difference between the density in the reference image region and a reference density is equal to or smaller than a predetermined threshold value, and an area ratio of the density in the reference image region is equal to or higher than a predetermined threshold value, the density correction control unit updates the correction data.

4. The image forming apparatus according to claim 1, wherein, when updating the correction data, the density correction control unit sets a length of the correction patch image in accordance with the length of the reference image region in the sub-scan direction.

5. An image forming apparatus comprising:

an image forming unit including a rotating member as a component, the image forming unit being configured to form an image on a paper sheet in accordance with print job data;

a rotation position detecting unit configured to detect a rotation position of the rotating member;

an image density detecting unit configured to detect a density in an image formed on an image carrier by the image forming unit;

an image information analyzing unit configured to analyze image information included in the print job data;

a density profile managing unit configured to form a correction patch image on the image carrier, and create and manage a density profile indicating periodical density unevenness in accordance with a result of the detection performed by the image density detecting unit with respect to the correction patch image;

a correction data creating unit configured to create correction data corresponding to the rotation position of the rotating member in accordance with the density profile;

a density correcting unit configured to perform density correction using the correction data; and a density correction control unit configured to predict an appearance of periodical density unevenness in accordance with image information about the image to be formed, and set conditions for the density correction in accordance with a result of the prediction;

wherein the density correction control unit separates the image into respective color components, and sets the conditions for the density correction for each of the color components.

6. A non-transitory recording medium storing a computer readable program to be used in an image forming apparatus including an image forming unit configured to form an image on a paper sheet in accordance with print job data, the image forming unit including a rotating member as a component, the program comprising:

a rotation position detecting step of detecting a rotation position of the rotating member;

an image density detecting step of detecting a density in an image formed on an image carrier by the image forming unit;

an image information analyzing step of analyzing image information included in the print job data;

a density profile managing step of forming a correction patch image on the image carrier, and creating and managing a density profile indicating periodical density unevenness in accordance with a result of the detection performed in the image density detecting step with respect to the correction patch image;

a correction data creating step of creating correction data corresponding to the rotation position of the rotating member in accordance with the density profile;

a density correcting step of performing density correction using the correction data; and a density correction control step of predicting an appearance of periodical density unevenness in accordance with image information about the image to be formed, and setting conditions for the density correction in accordance with a result of the prediction;

wherein the density correction control step includes extracting image regions from the image, determining a reference image region in accordance with lengths of the extracted image regions in a sub-scan direction and densities in the extracted image regions, and setting the conditions for the density correction in accordance with the length of the reference image region in the sub-scan direction and the density in the reference image region;

wherein the density correction control step includes determining whether to update the correction data, in accordance with the length of the reference image region in the sub-scan direction and the density in the reference image region; and wherein the density correction control step includes updating the correction data when the length of the reference image region in the sub-scan direction is equal to or greater than a cycle length of the rotating member, and a difference between the density in the reference image region and a reference density is equal to or smaller than a predetermined threshold value.

7. The non-transitory recording medium storing a computer readable program according to claim 6, wherein the image information includes size information, color information, density information, and page information about the image included in the print job data, and size information about the paper sheet on which the image is to be formed.

8. The non-transitory recording medium storing a computer readable program according to claim 6, wherein the density correction control step includes updating the correction data when the length of the reference image region in the sub-scan direction is equal to or greater than a cycle length of the rotating member, a difference between the density in the reference image region and a reference density is equal to or smaller than a predetermined threshold value, and an area ratio of the density in the reference image region is equal to or higher than a predetermined threshold value.

9. The non-transitory recording medium storing a computer readable program according to claim 6, wherein the density correction control step includes setting a length of the correction patch image in accordance with the length of the reference image region in the sub-scan direction, when updating the correction data.

10. A non-transitory recording medium storing a computer readable program to be used in an image forming apparatus including an image forming unit configured to form an image on a paper sheet in accordance with print job data, the image forming unit including a rotating member as a component, the program comprising:

a rotation position detecting step of detecting a rotation position of the rotating member;

an image density detecting step of detecting a density in an image formed on an image carrier by the image forming unit;

an image information analyzing step of analyzing image information included in the print job data;

a density profile managing step of forming a correction patch image on the image carrier, and creating and managing a density profile indicating periodical density unevenness in accordance with a result of the detection performed in the image density detecting step with respect to the correction patch image;

a correction data creating step of creating correction data corresponding to the rotation position of the rotating member in accordance with the density profile;

a density correcting step of performing density correction using the correction data; and a density correction control step of predicting an appearance of periodical density unevenness in accordance with image information about the image to be formed, and setting conditions for the density correction in accordance with a result of the prediction;

wherein the density correction control step includes separating the image into respective color components, and setting the conditions for the density correction for each of the color components.

* * * * *